US007115824B2

(12) United States Patent
Lo

(10) Patent No.: US 7,115,824 B2
(45) Date of Patent: Oct. 3, 2006

(54) TILT SWITCH AND SYSTEM

(76) Inventor: Kam Chun Lo, Room 10-11, 8/F. Favor Ind. Centre, 2-6 Kin Hong Street, Kwai Chung, NT (HK)

( * ) Notice: Subject to any disclaimer, the term of this patent is extended or adjusted under 35 U.S.C. 154(b) by 0 days.

(21) Appl. No.: 11/196,665

(22) Filed: Aug. 2, 2005

(65) Prior Publication Data

US 2006/0027447 A1 Feb. 9, 2006

Related U.S. Application Data

(60) Provisional application No. 60/598,586, filed on Aug. 3, 2004.

(51) Int. Cl.
*H01H 35/02* (2006.01)

(52) U.S. Cl. ..... 200/61.52; 200/61.45 R

(58) Field of Classification Search ..... 200/61.49, 200/61.45 R–61.53, 61.45 M, 61.83, DIG. 29, 200/277–277.2
See application file for complete search history.

(56) References Cited

U.S. PATENT DOCUMENTS 3,643,049 A * 2/1972 Lu Conic et al. ..... 200/503
4,099,040 A * 7/1978 Bitko ..... 200/220
4,135,067 A * 1/1979 Bitko ..... 200/61.52
4,513,183 A 4/1985 Hill
4,618,746 A * 10/1986 Schwob et al. ..... 200/61.45 R
4,628,160 A 12/1986 Canevari
5,136,127 A * 8/1992 Blair ..... 200/61.52
5,209,343 A * 5/1993 Romano et al. ..... 200/61.52
5,256,839 A * 10/1993 Gallagher ..... 200/61.52
5,332,876 A * 7/1994 Romano et al. ..... 200/61.52
5,373,125 A * 12/1994 Ford et al. ..... 200/61.52
5,747,762 A * 5/1998 Fukuda et al. ..... 200/61.45 R
6,011,254 A * 1/2000 Sano et al. ..... 250/231.1
6,198,059 B1 * 3/2001 Jou ..... 200/61.52
6,348,665 B1 * 2/2002 Ohashi et al. ..... 200/61.52
6,448,517 B1 * 9/2002 Ogden ..... 200/61.46
6,518,523 B1 * 2/2003 Chou ..... 200/61.52
6,706,978 B1 * 3/2004 Wagatsuma et al. .. 200/61.45 R
6,917,004 B1 * 7/2005 Engdahl ..... 200/61.45 R

* cited by examiner

*Primary Examiner*—Michael Friedhofer
*Assistant Examiner*—Lisa Klaus
(74) *Attorney, Agent, or Firm*—Billy Lau

(57) ABSTRACT

A tilt switch has an electrical terminal on its top end and an electrical terminal on its bottom end. It comprises a conductive can with an opening on the top end side serving as the electrical terminal on the bottom end and a conductive cap covering the opening of the conductive can serving as the electrical terminal on the top end. An insulator member attached to the conductive can surrounding the side of the conductive cap insulating the conductive cap from said conductive can. Inside the conductive can is at least one rollable conductive member. The rollable conductive member is not in electrical contact with the conductive cap when resting on the bottom inside said conductive can. A system, which includes electrical circuits that employ the tilt switch, is responsive to the orientation of the tilt switch.

36 Claims, 3 Drawing Sheets

TILT SWITCH AND SYSTEM

CROSS-REFERENCE TO RELATED APPLICATION

This application claims the benefit of Provisional Patent Application Ser. No. 60/598,586 filed on Aug. 03, 2004, which is incorporated by reference herein.

FIELD OF THE INVENTION

The invention is related to a tilt switch and a system that employs this tilt switch.

BACKGROUND

Tilt switches have numerous applications, including for example, orientation sensing, motion sensing, and acceleration sensing. There is a large number of existing tilt switch designs. Selected examples of tilt switch design may be found in U.S. Pat. No. 4,513,183 to Hill, U.S. Pat. No. 4,628,160 to Canevari, U.S. Pat. Nos. 5,136,127, and 5,209,343 to Romano, et al. A tilt switch includes a number of mechanical components. Representative methods for manufacturing these mechanical components include casting, molding, machining, stamping and sheet metal stamping, extruding, or a combination thereof. Machining is among the costly manufacturing methods and machined mechanical components typically have relatively high manufacturing cost. Sheet metal stamping is among the inexpensive manufacturing methods and stamped sheet metal mechanical components typically have relatively low manufacturing cost. Tilt switches according to many of the selected example designs above may be relatively costly because of they employ high manufacturing cost mechanical components. An object of the present invention is to provide selected example embodiments that employ low manufacturing cost mechanical components. Another object of the present invention is to provide selected example embodiments that have geometry of and electrical terminals that are compatible with selected batteries, for example, a button cell.

DESCRIPTION OF THE DRAWINGS

A better understanding of the invention may be gained from the consideration of the following detailed description taken in conjunction with the accompanying drawing in which.

DETAILED DESCRIPTION OF THE INVENTION

Figure 1:
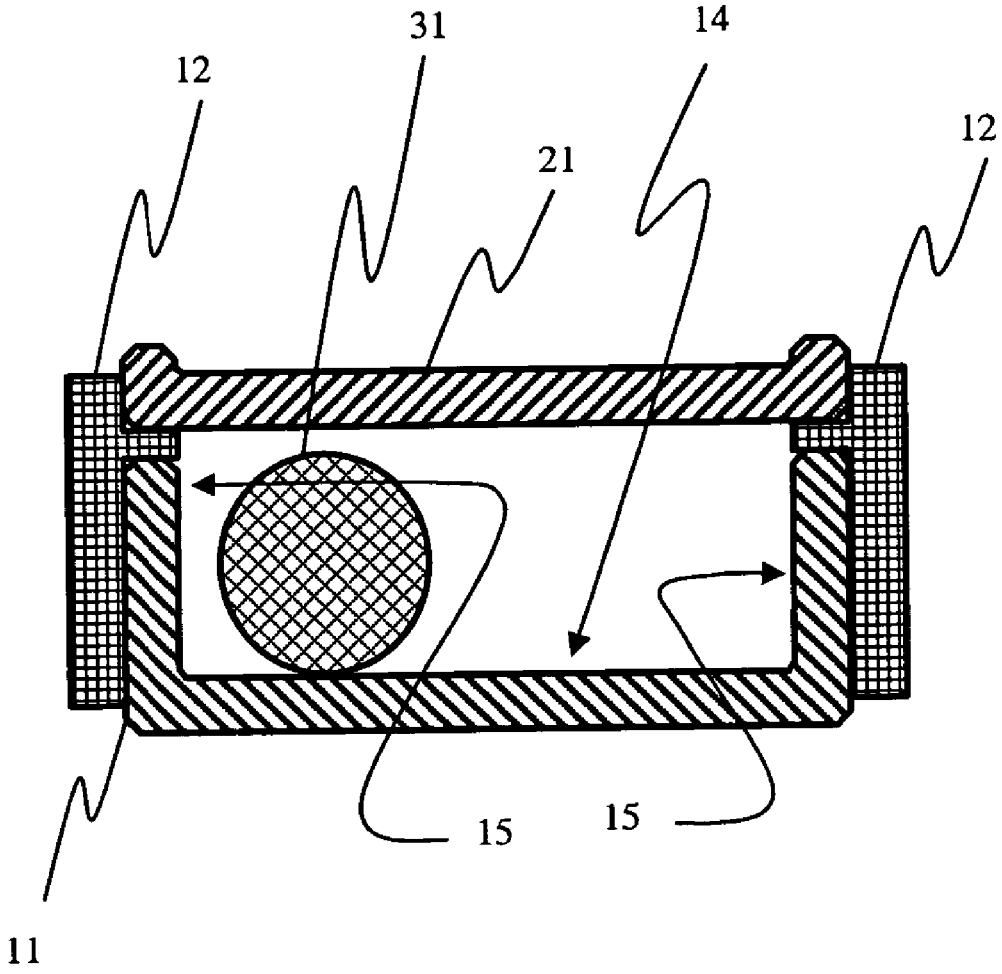
FIG. 1 shows a sectional view of an embodiment of the present invention.

In the description that follows, like parts are indicated throughout the specification and drawings with the same reference numerals. The present invention is not limited to the specific embodiments illustrated herein.

According to an embodiment of the present invention, a tilt switch comprises a can assembly, which has an opening extending into a cavity in the can assembly; a cap assembly covering the opening to the can assembly; and a rollable conductive member in the cavity. FIG. 1 shows a sectional view of an embodiment of the present invention. Referring to FIG. 1, the can assembly comprises a conductive can 11 and an insulator member 12. At the opening of the can assembly is a cap assembly. The cap assembly comprises a conductive cap 21. FIG. 1 shows that the thickness of conductive can 11 and the thickness of conductive cap 21 are substantially uniform, particularly in their respective center section. An example fabrication method of this embodiment is press-fitting conductive cap 21 and conductive can 11 onto insulator member 12. Bonding conductive cap 21 and conductive can 11 on insulator member 12 using an adhesive is another example fabrication method. Inside the cavity that is in the can assembly and covered by the cap assembly is a rollable conductive member. The rollable conductive member is conductive rolling ball 31 in this embodiment. Conductive rolling ball 31 may roll inside the cavity when the embodiment experiences acceleration. Conductive cap 21 and conductive can 11 are the electrical terminals of the embodiment. When the embodiment is in a leveled position as shown in FIG. 1, conductive rolling ball 31 rests on the bottom 14 of the cavity in conductive can 11. The spacing between bottom 14 of the cavity inside conductive can 11 and conductive cap 21 is such that conductive rolling ball 31 will not touch conductive cap 21 when it is resting on bottom 14. In this leveled position, there is no electrical connection between conductive cap 21 and conductive can 11 through the embodiment. The embodiment is off.

The inside wall of conductive can 11 is the inside wall 15 of the can assembly in this embodiment. When the embodiment is in a predetermined range of tilt positions, conductive rolling ball 31 rests on both conductive cap 21 and the inside wall 15 of conductive can 11. Conductive rolling ball 31 establishes an electrical connection between conductive can 11 and conductive cap 21. The embodiment is on.

Figure 2:
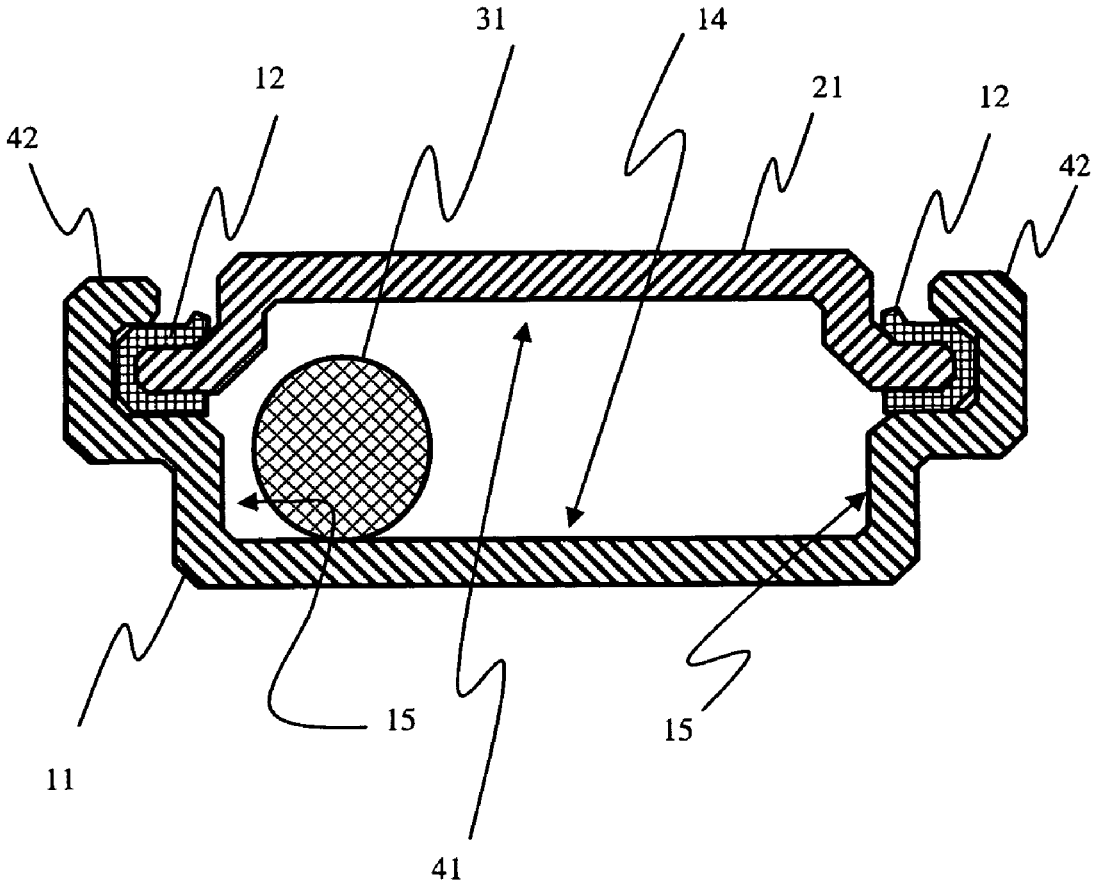
FIG. 2 shows a sectional view of an alternative embodiment of the present invention.

FIG. 2 shows a sectional view of an alternative embodiment of the present invention. Referring to FIG. 2, insulator member 12 of the can assembly covers the edge of conductive cap 21 of the cap assembly. Conductive cap 21 caps the opening of conductive can 11. At the center of conductive cap 21 is a raised section 41. A lip 42 extending from conductive can 11 holds conductive cap 21 in position. Insulator member 12 prevents conductive cap 21 from coming in electrical contact with conductive can 11. Inside the cavity defined by the can assembly and the cap assembly is a conductive rolling ball 31. Conductive rolling ball 31 can freely roll inside the cavity. When the embodiment is in a leveled position as shown in FIG. 2, conductive rolling ball 31 rests on the bottom 14 of the cavity in conductive can 11. There is a gap between conductive rolling ball 31 and conductive cap 21. Hence, there is no electrical connection between conductive cap 21 and conductive can 11 through the embodiment. The embodiment is off.

In this embodiment, the inside wall of conductive can 11 is the inside wall 15 of the can assembly. When the embodiment is in a predetermined range of tilt positions, conductive rolling ball 31 rests on both conductive cap 21 and the inside wall 15 of conductive can 11. Conductive rolling ball 31 establishes an electrical connection between conductive can 11 and conductive cap 21. The embodiment is on.

Figure 3:
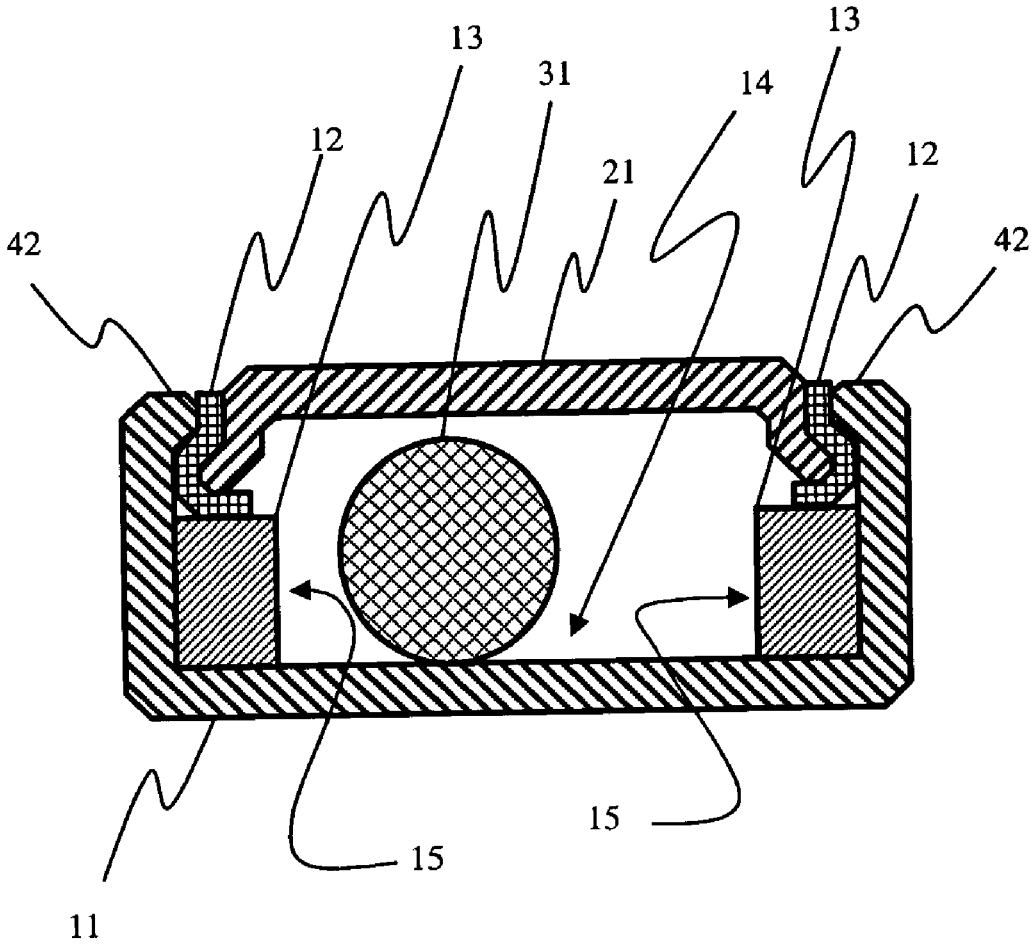
FIG. 3 shows a sectional view of a second alternative embodiment of the present invention.

FIG. 3 shows a sectional view of an alternative embodiment of the present invention. Referring to FIG. 3, the can assembly comprises a conductive can 11, a conductive ring 13 inside conductive can 11, and an insulator member 12. Conductive ring 13 is in electrical contact with conductive can 11. The inside wall of conductive ring 12 is the inside wall 15 of the can assembly in this embodiment. Covering the opening of the can assembly is a cap assembly. The cap assembly comprises a conductive cap 21. The center of the conductive cap 21 is raised. Insulator member 12 covers the edge of conductive cap 21 and prevents conductive cap 21 from coming in electrical contact with conductive can 11 and conductive ring 13. The covered edge of conductive cap 21 rests on conductive ring 13. A lip 42 formed on conductive can 11 keeps conductive cap 21 in position. Inside the cavity defined by the can assembly and the cap assembly is a conductive rolling ball 31. When the present invention is at a leveled position as shown in FIG. 3, conductive rolling ball 31 rests on the bottom 14 of conductive can 11. There is no electrical connectivity between conductive can 11 and conductive cap 21 through the embodiment. The embodiment is off. When the embodiment is in a predetermined range of tilt positions, conductive rolling ball 31 rests on both conductive cap 21 and the inside wall 15 of conductive ring 13, and establishes electrical connectivity between conductive can 11 and conductive cap 21. The embodiment is on.

Numerous systems may employ a tilt switch, such as an embodiment according to the present invention. Common example applications of a tilt switch in a system include, but are not limited to, a tilt sensor, a motion sensor, an orientation senor, an inertia sensor, an acceleration sensor, activation switch, and a power switch. Such applications and systems are well known to one skill in the art and do not require explanations. Examples of systems that may employ a tilt switch, such as an embodiment of the present invention, include, but are not limited to, vehicles, alarm systems, toys, appliances, instruments, exercise systems, display systems, ornamentation display system, accessories, novelty items, promotional items, calculators, lights, keychain lights, buttons, pens, and mobile phones. Many of these systems include a commercial-off-the-self controller, which is arranged to monitor the tilt switch.

There are numerous variations to the embodiments above trivial to the ones skilled in the art. Examples of these variations include but not limited to:

The raised section 41 of conductive cap 21 is not flat;

The wall thickness of conductive cap 21 is non-uniform;

The bottom of conductive can 11 is not flat;

The wall thickness of conductive can 11 is non-uniform;

Conductive can 11 may have slots or perforations;

Conductive cap 21 may have slots or perforations;

Some slots or perforations of conductive can 11 or conductive cap 21 may extend to the edge;

There may be other conductive members or insulator members on the can assembly;

The cap assembly may include other conductive or insulator members, for example, an insulator rod or an insulator patch extending from the center of conductive cap 21 into the cavity in the can assembly;

The conductive members or insulator members may be attached to or an integral part of a component of the cap assembly or the can assembly;

An example rollable conductive member is a metal ball;

Other examples of rollable conductive member include a conductive plastic dice and a metal cylinder;

Conductive wires or strips may be attached to and electrically connected to the conductive cap 21 or conductive can 11;

An embodiment may be shaped like a battery and the locations of the electrical terminals on the embodiment may the identical to the locations of the battery terminals on the battery;

An embodiment, for example the one shown in FIG. 3, may be shaped like a button battery or a coin cell battery;

An embodiment installed in a system may be arranged to switch power to an energy storage device such as a capacitor, optional circuitry is arranged to draw power from the energy storage device;

There may be multiple rollable members in the cavity; and

A combination or a subcombination of the above.

Although the embodiment of the invention has been illustrated and that the form has been described, it is readily apparent to those skilled in the art that various modifications may be made therein without departing from the spirit of the invention.

What is claimed is:

1. A tilt switch having a top end, a bottom end, and sides between said top end and said bottom end, and at least one electrical terminal on said top end and one electrical terminal on said bottom end, comprising:

a can assembly having a cavity and an opening into said cavity on said top end:

a cap assembly covering said opening of said can assembly; and a rollable conductive member in said cavity;

wherein:

said cap assembly comprises a conductive cap having substantially uniform thickness at least in the center section being said electrical terminal on said top end;

said can assembly, comprising:

a conductive can being said electrical terminal on said bottom end; and an insulator member insulating said conductive cap from said conductive can;

said can assembly surrounds said conductive cap so that said conductive cap is not exposed on the sides of said tilt switch;

said rollable conductive member when resting on the bottom inside said conductive can is not in electrical contact with said conductive cap; and said rollable conductive member rests on the inside wall of said can assembly and said conductive cap allowing electricity to flow between said conductive can and said conductive cap when said tilt switch is in a predetermined range of tilt positions.

2. A tilt switch as claimed in claim 1, wherein, the thickness of the bottom of said conductive can is substantially uniform.

3. A tilt switch as claimed in claim 1, wherein, the bottom of said conductive can is substantially flat.

4. A tilt switch as claimed in claim 3, wherein:

said conductive can assembly further comprises a conductive ring inside said conductive can; and said insulator member rests said conductive ring.

5. A tilt switch as claimed in claim 3, wherein, center section of said conductive cap is substantially flat.

6. A tilt switch as claimed in claim 5, wherein, said conductive cap comprises a raised section in the center section.

7. A tilt switch as claimed in claim 1, wherein, said rollable conductive member comprises a conductive ball.

8. A tilt switch as claimed in claim 1, wherein:

the geometry of said tilt switch is substantially identical to the geometry of a battery so that said tilt switch can fit into a space designed for said battery; and the geometries and locations of said terminals on said tilt switch are substantially identical to the geometries and locations of the battery terminals on said battery.

9. A tilt switch as claimed in claim 8, wherein, said battery comprises a button cell.

10. A tilt switch having a top end, a bottom end, and sides between said top end and said bottom end, and at least one electrical terminal on said top end and one electrical terminal on said bottom end, comprising:

a can assembly having a cavity and an opening into said cavity on said top end:

a cap assembly covering said opening of said can assembly; and at least one rollable conductive member in said cavity;

wherein:

said cap assembly comprises a conductive cap having substantially uniform thickness at least in the center section being said electrical terminal on said top end;

said can assembly, comprising:

a conductive can being said electrical terminal on said bottom end; and an insulator member insulating said conductive cap from said conductive can;

said rollable conductive member when resting on the bottom inside said conductive can is not in electrical contact with said conductive cap;

said rollable conductive member rests on the inside wall of said can assembly and said conductive cap allowing electricity to flow between said conductive can and said conductive cap when said tilt switch is in a predetermined range of tilt positions;

the geometry of said tilt switch is substantially identical to the geometry of a button cell battery so that said tilt switch can fit into a space designed for said button cell battery; and the geometries and locations of said terminals on said tilt switch are substantially identical to the geometries and locations of the button cell battery terminals on said button cell battery.

11. A tilt switch as claimed in claim 10, wherein, said can assembly surrounds said conductive cap so that said conductive cap is not exposed on the sides of said tilt switch.

12. A tilt switch as claimed in claim 10, wherein, the thickness the center section of said conductive cap is substantially uniform.

13. A tilt switch as claimed in claim 12, wherein, the thickness of the bottom of said conductive can is substantially uniform.

14. A tilt switch as claimed in claim 13, wherein:

said conductive can assembly further comprises a conductive ring inside said conductive can; and said insulator member rests said conductive ring.

15. A tilt switch as claimed in claim 13, wherein, the bottom of said conductive can is substantially flat.

16. A tilt switch as claimed in claim 15, wherein, the center section of said conductive cap is substantially flat.

17. A tilt switch as claimed in claim 16, wherein, said conductive cap comprises a raised section in the center section.

18. A tilt switch as claimed in claim 10, wherein, said rollable conductive member comprises a conductive ball.

19. A system, comprising:

an electrical circuit; and a tilt switch connected to said electrical circuit having a top end, a bottom end, and sides between said top end and said bottom end, and at least one electrical terminal on said top end and one electrical terminal on said bottom end;

wherein:

said system being responsive to the tilt position of said tilt switch; and said tilt switch, comprising:

a can assembly having a cavity and an opening into said cavity on said top end;

a cap assembly covering said opening of said can assembly; and at least one rollable conductive member in said cavity;

wherein:

said cap assembly comprises a conductive cap having substantially uniform thickness at least in the center section being said electrical terminal on said top end;

said can assembly, comprising:

a conductive can being said electrical terminal on said bottom end; and an insulator member insulating said conductive cap from said conductive can;

said rollable conductive member when resting on the bottom inside said conductive can is not in electrical contact with said conductive cap;

said rollable conductive member rests on the inside wall of said can assembly and said conductive cap allowing electricity to flow between said conductive can and said conductive cap when said tilt switch is in a predetermined range of tilt positions;

the geometry of said tilt switch is substantially identical to the geometry of a button cell battery so that said tilt switch can fit into a space designed for said button cell battery; and the geometries and locations of said terminals on said tilt switch are substantially identical to the geometries and locations of the button cell battery terminals on said button cell battery.

20. A system as claimed in claim 19, wherein, said can assembly surrounds said conductive cap so that said conductive cap is not exposed on the sides of said tilt switch.

21. A system as claimed in claim 19, wherein, the thickness the center section of said conductive cap is substantially uniform.

22. A system as claimed in claim 21, wherein, the thickness of the bottom of said conductive can is substantially uniform.

23. A system as claimed in claim 22, wherein:

said conductive can assembly further comprises a conductive ring inside said conductive can; and said insulator member rests said conductive ring.

24. A system as claimed in claim 22, wherein, the bottom of said conductive can is substantially flat.

25. A system as claimed in claim 24, wherein, the center section of said conductive cap is substantially flat.

26. A tilt switch as claimed in claim 25, wherein, said conductive cap comprises a raised section in the center section.

27. A tilt switch as claimed in claim 19, wherein, said rollable conductive member comprises a conductive ball.

28. A system, comprising:

an electrical circuit; and a tilt switch connected to said electrical circuit having a top end, a bottom end, and sides between said top end and said bottom end, and at least one electrical terminal on said top end and one electrical terminal on said bottom end;

wherein:

said system being responsive to the tilt position of said tilt switch; and said tilt switch, comprising:

a can assembly having a cavity and an opening into said cavity on said top end:

a cap assembly covering said opening of said can assembly; and a rollable conductive member in said cavity;

wherein:

said cap assembly comprises a conductive cap having substantially uniform thickness at least in the center section being said electrical terminal on said top end;

said can assembly, comprising:

a conductive can being said electrical terminal on said bottom end; and an insulator member insulating said conductive cap from said conductive can;

said can assembly surrounds said conductive cap so that said conductive cap is not exposed on the sides of said tilt switch;

said rollable conductive member when resting on the bottom inside said conductive can is not in electrical contact with said conductive cap; and said rollable conductive member rests on the inside wall of said can assembly and said conductive cap allowing electricity to flow between said conductive can and said conductive cap when said tilt switch is in a predetermined range of tilt positions.

29. A system as claimed in claim 28, wherein, the thickness of the bottom of said conductive can is substantially uniform.

30. A system as claimed in claim 28, wherein, the bottom of said conductive can is substantially flat.

31. A system as claimed in claim 30, wherein:

said conductive can assembly further comprises a conductive ring inside said conductive can; and said insulator member rests said conductive ring.

32. A system as claimed in claim 30, wherein, center section of said conductive cap is substantially flat.

33. A system as claimed in claim 32, wherein, said conductive cap comprises a raised section in the center section.

34. A system as claimed in claim 28, wherein, said rollable conductive member comprises a conductive ball.

35. A system as claimed in claim 28, wherein:

the geometry of said tilt switch is substantially identical to the geometry of a battery so that said tilt switch can fit into a space designed for said battery; and the geometries and locations of said terminals on said tilt switch are substantially identical to the geometries and locations of the battery terminals on said battery.

36. A system as claimed in claim 35, wherein, said battery comprises a button cell.

* * * * *